US007703421B2

(12) United States Patent
Merchant et al.

(10) Patent No.: US 7,703,421 B2
(45) Date of Patent: Apr. 27, 2010

(54) COOLING ARRANGEMENT FOR A FUEL INJECTOR AND METHOD

(75) Inventors: Jack A. Merchant, Peoria, IL (US); Thomas D. Gens, Metamora, IL (US); Scott A. Wallington, Sparland, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/183,977

(22) Filed: Jul. 31, 2008

(65) Prior Publication Data

US 2010/0024746 A1 Feb. 4, 2010

(51) Int. Cl.
*F01P 3/00* (2006.01)
*F01P 1/06* (2006.01)
*F02M 51/00* (2006.01)

(52) U.S. Cl. ..... 123/41.42; 123/41.31; 123/470

(58) Field of Classification Search ..... 123/41.31, 123/41.42, 196 AB, 470, 471
See application file for complete search history.

(56) References Cited

U.S. PATENT DOCUMENTS 3,431,895 A 3/1969 Bailey
4,246,877 A 1/1981 Kennedy
4,485,790 A 12/1984 Nishimura et al.
5,960,774 A 10/1999 Norgauer et al.
6,196,194 B1 3/2001 Mitchell
6,269,796 B1 8/2001 Mitchell
6,276,338 B1 8/2001 Kato et al.
6,338,333 B1 1/2002 Brosseau et al.
6,431,152 B1 * 8/2002 Estacio ..... 123/470
6,532,939 B2 3/2003 Ozeki
6,811,102 B2 11/2004 Krause et al.
6,830,036 B2 12/2004 Okajima et al.

* cited by examiner

*Primary Examiner*—Noah Kamen
(74) *Attorney, Agent, or Firm*—Leydig, Voit & Mayer Ltd; Carl E. Myers

(57) ABSTRACT

A plurality of injector hold-down clamps (310) is arranged to connect, one each, each of a plurality of fuel injectors (106) to an internal combustion engine (100). Each fuel injector forms a neck region (212), and each clamp surrounds each injector around the neck region, such that a plurality of annular volumes (604) is defined, one each, between the neck region of each injector and each injector clamp. Each annular volume collects a quantity of lubrication oil during operation of the internal combustion engine such that the volume of oil collected in each respective annular volume removes heat from the respective fuel injector.

20 Claims, 6 Drawing Sheets

COOLING ARRANGEMENT FOR A FUEL INJECTOR AND METHOD

TECHNICAL FIELD

This patent disclosure relates generally to cooling arrangements for fuel injectors on internal combustion engines and, more particularly, to a cooling arrangement for a fuel injector that removes heat from the fuel injector with engine lubrication oil.

BACKGROUND

Internal combustion engines using injectors associated with each cylinder are known. A typical fuel injector includes various valves and valve arrangements operating to inject fuel into the cylinder in a controlled fashion. These valves are controlled, typically, by electronic actuators associated with each fuel injector. Each fuel injector is capable of injecting a quantity of fuel into a cylinder of an internal combustion engine at pre-determined times and for pre-determined durations. A typical injector is positioned beneath the valve cover of the engine and in direct fluid communication with the cylinder. During operation, electrical signals sent to the fuel injector actuate a valve that injects fuel into the cylinder.

Modern engines inject fuel into their cylinders at high pressures. Compression of fuel at a high pressure increases its temperature, which in turn may increase the temperature within the fuel injector during operation of the engine. Various electronic components associated with the fuel injector, which typically control the injector valve, are required to operate below certain temperatures. The current trend is to increase injection pressures for fuel and internal combustion engines, which in turn creates potential thermal issues associated with maintaining the temperature of the fuel injector, particularly, the temperature of electronic components associated therewith, within pre-determined ranges. Moreover, increased temperatures of the fuel injector, and of the fuel being injected, tend to increase the oxidization of fuel being injected. This in turn, breaks down certain fuel compounds, which potentially causes debris to be deposited on various surfaces of the injector valves. This debris can often lead to sluggish operation and/or sticking of the injector.

SUMMARY

The disclosure describes, in one aspect, an internal combustion engine that includes a crankcase forming a plurality of cylinders, each associated with a fuel injector. Each of a plurality of injector hold-down clamps is arranged to connect a respective fuel injector to the engine. Each fuel injector forms a neck region, and each clamp surrounds each injector around the neck region to define a plurality of annular volumes, one each, between the neck region of each injector and each injector clamp. During operation of the internal combustion engine, each annular volume collects a quantity of lubrication oil to remove heat from the respective fuel injector.

In another aspect, this disclosure provides a method for cooling a fuel injector in an internal combustion engine. The method includes collecting lubrication fluid in an annular volume disposed between a fuel injector clamp and a portion of the fuel injector, and retaining a quantity of fluid in the annular volume for a time period. The quantity of fluid collected in the annular volume absorbs heat from a portion of the fuel injector that at least partially defines the annular volume. At least a portion of the quantity of fluid drains via a leak path, which is defined between the fuel injector clamp and the fuel injector, from the annular volume. The portion of lubrication fluid drained through the leak path is replenished to maintain the quantity of fluid in the annular volume substantially constant. The process repeats while the engine operates.

In yet another aspect, this disclosure describes a hold-down clamp for securing a fuel injector to an internal combustion engine. The hold-down clamp includes an injector retaining portion forming an injector opening. The injector opening is adapted to accept a neck region formed externally on each fuel injector. The hold-down clamp further includes a fastener portion forming a fastener opening adapted to receive a fastener passing therethrough. The fastener operably engages a portion of the internal combustion engine such that the fuel injector disposed within the injector retaining portion is secured to the internal combustion engine. The injector hold down clamp is separable into at least two portions, a first portion including a first segment of an injector opening, and a second portion forming a remaining segment of the injector opening.

DETAILED DESCRIPTION

This disclosure relates to internal combustion engines and, more particularly, to fuel injectors and fuel systems associated with these engines. The embodiments described herein provide methods and devices capable of achieving an active cooling of each of a plurality of fuel injectors in the internal combustion engine during operation. In one embodiment, engine lubrication oil is supplied to each fuel injector so that a flow of oil over and through certain portions of the injector is achieved. This flow of oil can advantageously remove heat from the fuel injector, thus maintaining a desirable temperature for the injector and various internal components that are operating therein.

Figure 1:
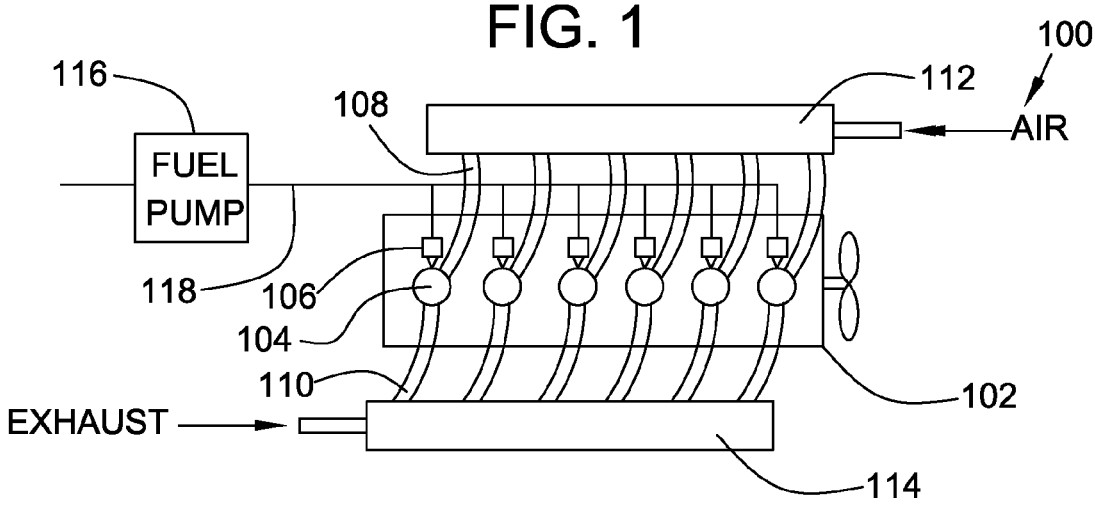
FIG. 1 is a block diagram of an internal combustion engine in accordance with the disclosure.

FIG. 1 shows a block diagram for an internal combustion engine 100. The internal combustion engine 100 includes a crankcase 102 forming a plurality of cylinders 104. Each cylinder 104 is operably associated with a fuel injector 106, an intake air runner 108, and an exhaust gas runner 110.

During operation of the engine 100, air enters each cylinder 104 via its respective intake air runner 108. While in the cylinder 104, the air mixes with fuel injected from the fuel injector 106 to form a combustible mixture. The combustible mixture is compressed via a piston (not shown) and ignites producing power. Exhaust gas remaining in the cylinder 104 is evacuated via the respective exhaust gas runner 110 and the process is repeated. Air entering each cylinder via its respective intake air runner 108 is supplied to the intake air runners 108 through an intake manifold 112. Similarly, exhaust gas from the cylinders 104 is collected in an exhaust manifold 114. The fuel supplied to each injector 106 is compressed by a fuel pump 116, which supplies compressed fuel to a common rail 118 that is in fluid communication with each of the injectors 106.

Figure 2:
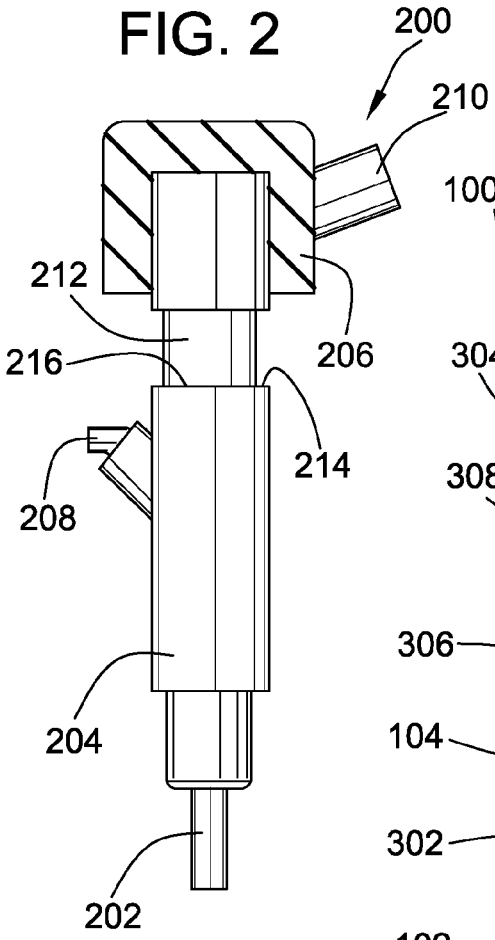
FIG. 2 is an outline view of a fuel injector having a neck region in accordance with the disclosure.

An outline view of a fuel injector 200 is shown in FIG. 2. The injector 200 includes a nozzle portion 202, a body portion 204, and an actuator portion 206. The nozzle portion 202 includes a needle valve (not shown). During operation, the needle valve reciprocates within a needle housing (not shown) formed in the body portion 204 of the fuel injector 200. The reciprocal motion of the needle valve opens and closes a fluid path to permit fuel to enter the fuel injector via a fuel inlet 208. Fuel from the fuel inlet port 208 exits the injector via openings in the nozzle when the needle valve is retracted, and remains within the injector 200 when the needle valve is extended or seated. As can be appreciated, other fuel injector configurations may be used. In the present embodiment, a generic fuel injector is presented for the sake of simplicity.

The actuator portion 206 includes an electronic actuator (not shown), which may be, for example, a solenoid, a piezoelectric actuator, or any other suitable type of actuator. Electrical signals reaching the actuator portion 206 via an electrical connector 210 control movement of the actuator and, thereby, operation of the needle valve in the nozzle portion 202.

The body portion 204 of the fuel injector 200 forms a channel or neck region 212. The neck region 212 has a reduced diameter in comparison to surrounding portions of the body portion 204. Specifically, the neck region 212 forms a ledge 214 having a surface 216 that extends annularly around the body portion 204 in a direction toward the nozzle portion 202.

Figure 3:
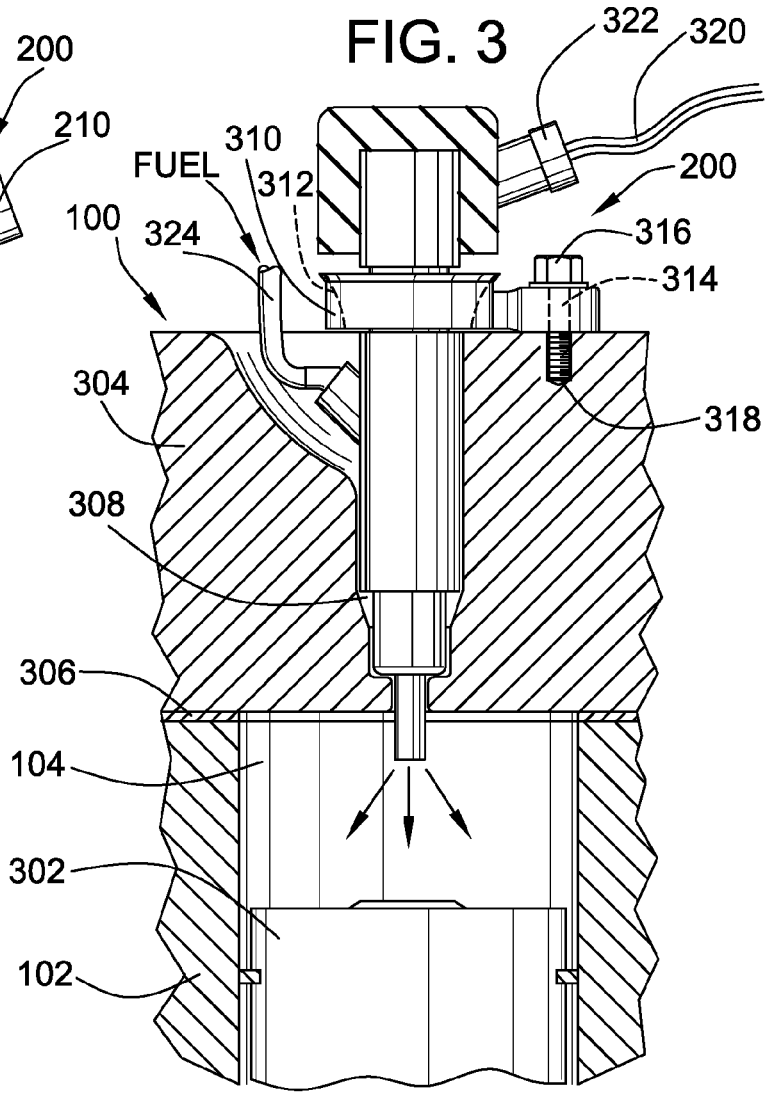
FIG. 3 is a partial cross section of a fuel injector installed in an internal combustion engine in accordance with the disclosure.

A partial cross-section of the injector 200 installed in the engine 100 is shown in FIG. 3. The engine crankcase 102 includes a cylinder head 304 against which the cylinder 104 is sealed. The cylinder 104 houses a reciprocating piston 302. A portion of the cylinder head 304 is connected to the crankcase 102 and a gasket 306 seals around the cylinder 104. The cylinder head 304 includes an injector bore 308 formed therein. The injector bore 308 extends through the cylinder head 304 such that the injector 200 has its nozzle portion 202 (FIG. 2) disposed adjacent to or partially within the cylinder 104 when disposed in the bore 308.

An injector clamp 310 connects the injector 200 to the cylinder head 304 and retains the injector 200 at a desired location within the bore 308. In one embodiment, two openings are formed in the injector clamp 310: an injector opening 312; and a fastener opening 314. As explained below, the injector opening 312 collects fluid to reduce the temperature of the injector 200 during operation. A fastener 316 passes through the fastener opening 314 and threadably engages the cylinder head 304 via a threaded opening 318 formed in the cylinder head 304.

During operation of the engine 100, pressurized fuel enters the injector 200 and is injected within the cylinder 104. Electrical signals commanding operation of the injector 200 are communicated to the actuator portion 206 (FIG. 2) via a group of electrical conductors 320, which are connected to the actuator portion 206 with a connector 322. A fuel conduit 324 fluidly communicating with the fuel pump 116 (FIG. 1) conveys pressurized fluid through the fuel inlet port 208 (FIG. 2). The conduit 324 can be connected to the injector 200 in any manner known in the art.

Figure 4:
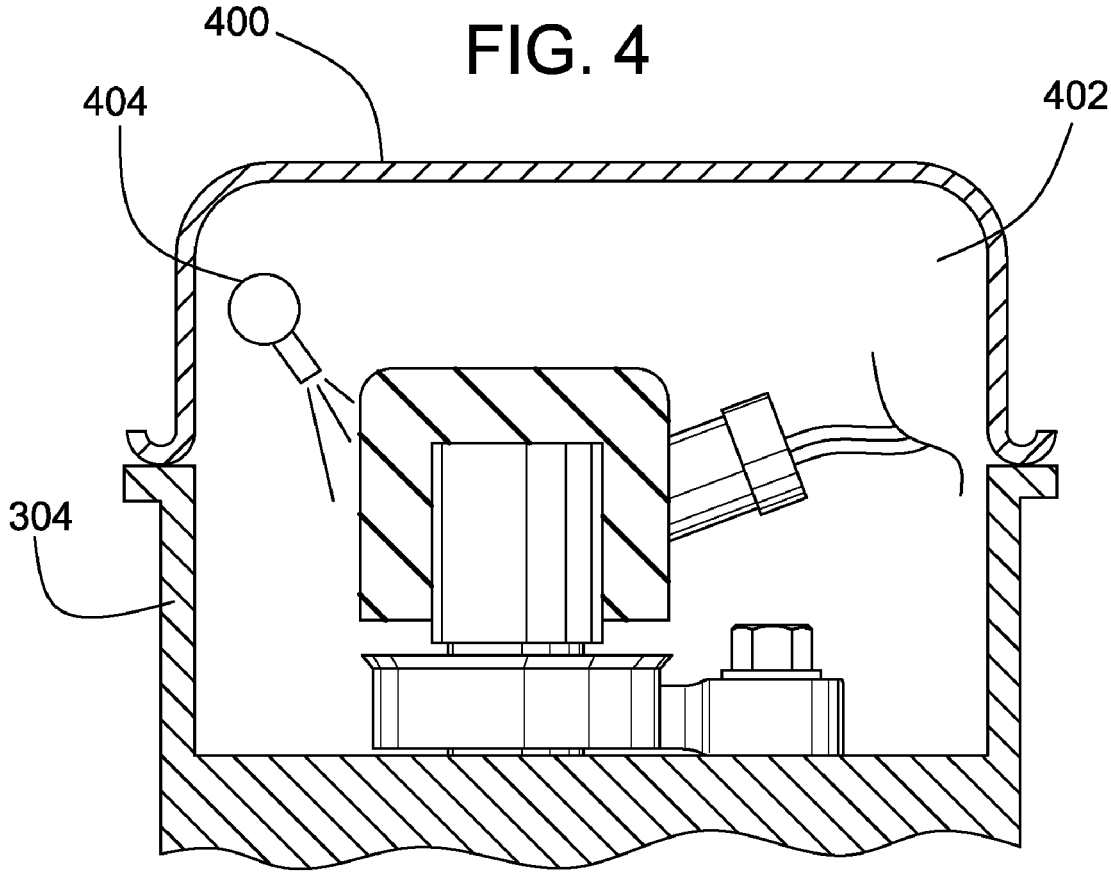
FIG. 4 is a partial cross section of an injector cooling configuration for an internal combustion engine in accordance with the disclosure.

FIG. 4 is a partial cross-section of a portion of the engine showing a valve cover 400 covering a portion of a cylinder head 304, with an injector 200 (FIGS. 2 and 3) installed there under. The valve cover 400 encloses an under-valve-cover volume 402, which typically includes various mechanical and electrical components of the engine. Such components include, for example, fuel injectors and associated electrical connectors, components of the valve actuation system of the engine, and so forth. In this embodiment, an additional lubrication system is provided. The lubrication system may be used to spray lubrication fluid, such as oil, onto various moving components of the engine that reside within the under-valve-cover volume 402. The lubrication system may include a plurality of spray nozzles 404, which are arranged to direct a stream of oil onto one or more particular locations underneath the valve cover 400. In the embodiment shown, the spray nozzle 404 is arranged to direct a steady stream of lubricating fluid toward the interface between the injector 200 and the injector clamp 310 (FIG. 3). This stream of lubricating fluid can advantageously be supplied continuously or intermittently during operation of the engine 100 (FIG. 1).

Figure 5:
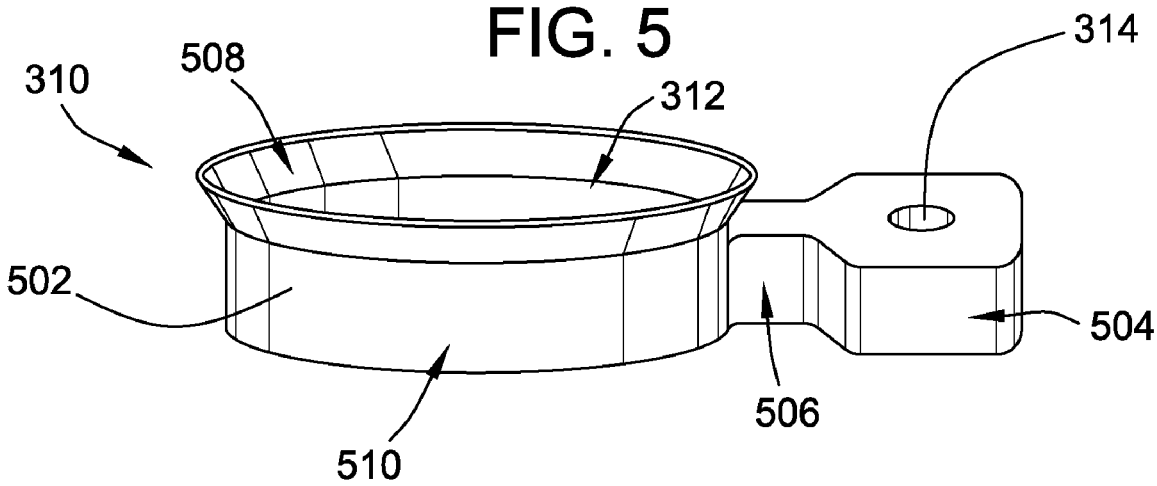
FIG. 5 is an outline view of a hold down clamp for a fuel injector in accordance with the disclosure.

An outline view of the injector clamp 310 is shown in FIG. 5. The clamp 310 includes an injector engaging portion 502 and a fastener portion 504. The injector engaging portion 502 forms the injector opening 312. The fastener portion 504 forms the fastener opening 314. A neck portion 506 connects the injector engaging portion 502 with the fastener portion 504.

Figure 6:
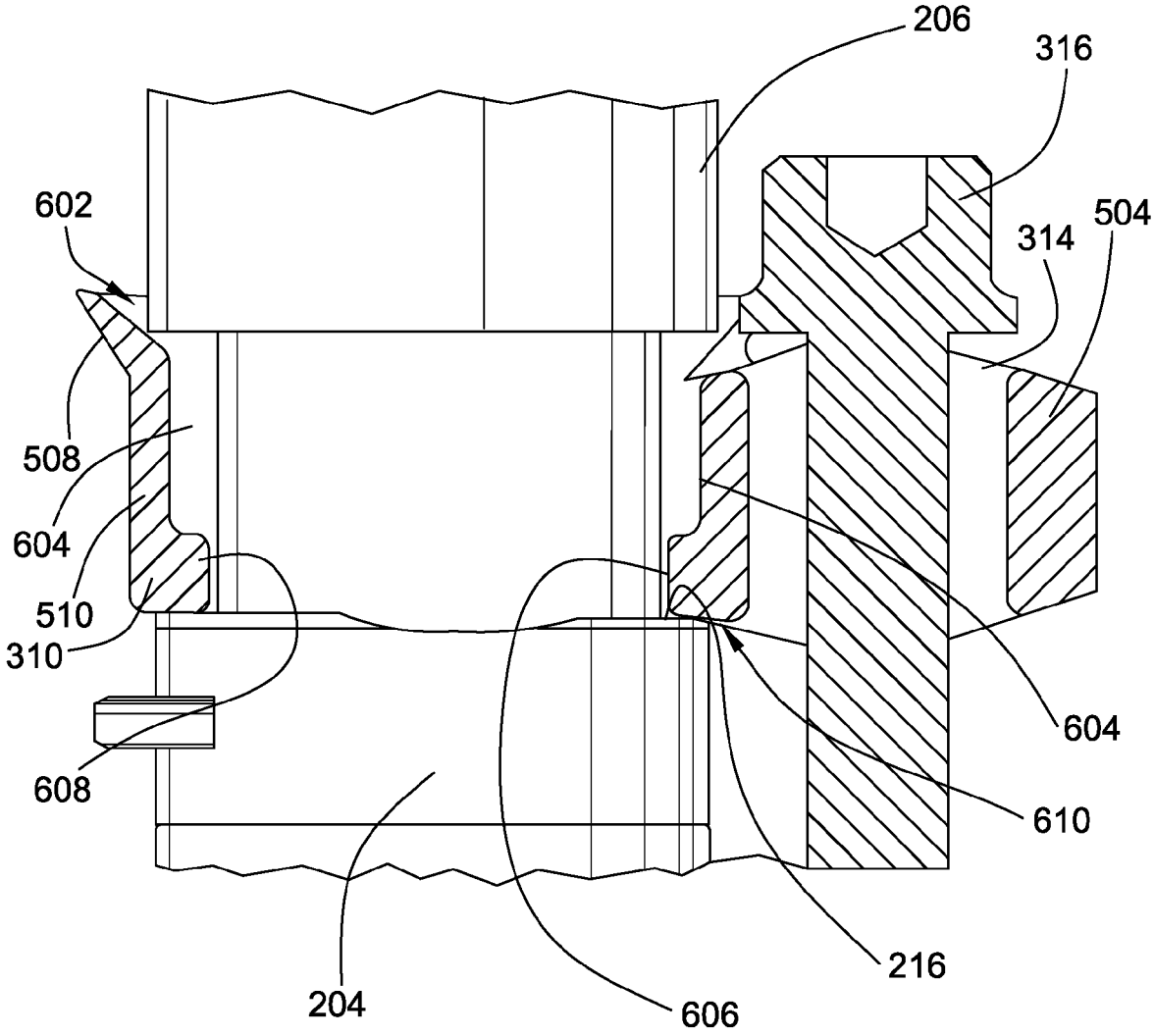
FIG. 6 is a cross section of a hold down clamp for an injector in accordance with the disclosure.

The injector engaging portion 502 has a generally cylindrical shape having a tapered or funnel feature formed on one end thereof. Specifically, the injector engaging portion 502 has a collecting rim 508 that surrounds the injector opening 312. A generally cylindrical injector retaining portion 510 is disposed proximate to collecting rim 508 and, together with the collecting rim 508, defines the injector opening 312. When the injector 200 is disposed within the injector opening 312, as shown in FIG. 4, the collecting rim 508 creates an opening between the injector clamp 310 and the body portion 204 (FIG. 2) of the injector 200. A detailed view and cross section of this arrangement is shown in FIG. 6.

In the figures that follow, like features are denoted by like reference numerals as used in the preceding description for the sake of clarity. In the partial cross section view of FIG. 6, the neck region 212 of the injector 200 is shown surrounded by the injector engaging portion 502 of the injector clamp 310. In this view, the features used for cooling the injector 200 using lubrication oil can be more readily appreciated. As previously described, the collecting rim 508 of the injector clamp 310 defines an opening 602 between the injector clamp 310 and the injector 200. The opening 602 allows ingress of lubrication fluid there through, but the collecting rim 508 provides a funnel to facilitate entry of oil though the opening 602. Oil entering through the opening 602 is collected within an annular volume 604 that is defined between the outer diameter of the neck region 212 of the injector 200 and the inner diameter of the injector opening 312 of the clamp 310.

During operation of the engine 100, oil that has collected within the annular volume 604 is allowed to leak out of the volume 604 such that it can be replaced by additional oil entering through the opening 602. This circulation of oil through the annular volume 604 can provide conductive and convective cooling of the neck region 212 during operation. A drain passage or leak path 606 is formed between the injector clamp 310 and the neck region 212 of the injector 200 when the clamp 310 is assembled in surrounding relationship with respect to the neck region 212. This leak path 606 includes an axial portion defined between a protruding ledge 608 formed along the inside diameter of the injector opening 312 and the outer diameter of the neck region 212. This axial portion communicates with a radial portion of the leak path 606, which is defined between a distal face of the clamp 310 and the annular surface 216 formed adjacent to the edge of the neck region 212.

As can be appreciated, oil may collect in the annular volume 604 to conductively and/or convectively transfer heat away from the injector 200. The ability to collect oil within the annular volume 604 requires that the annular volume 604 extend substantially around the periphery of the injector 200. For this reason, and to facilitate assembly of the injector clamp 310 around the injector 200, the clamp 310 may be manufactured in the segmented fashion shown in FIGS. 7 and 8.

Figure 7:
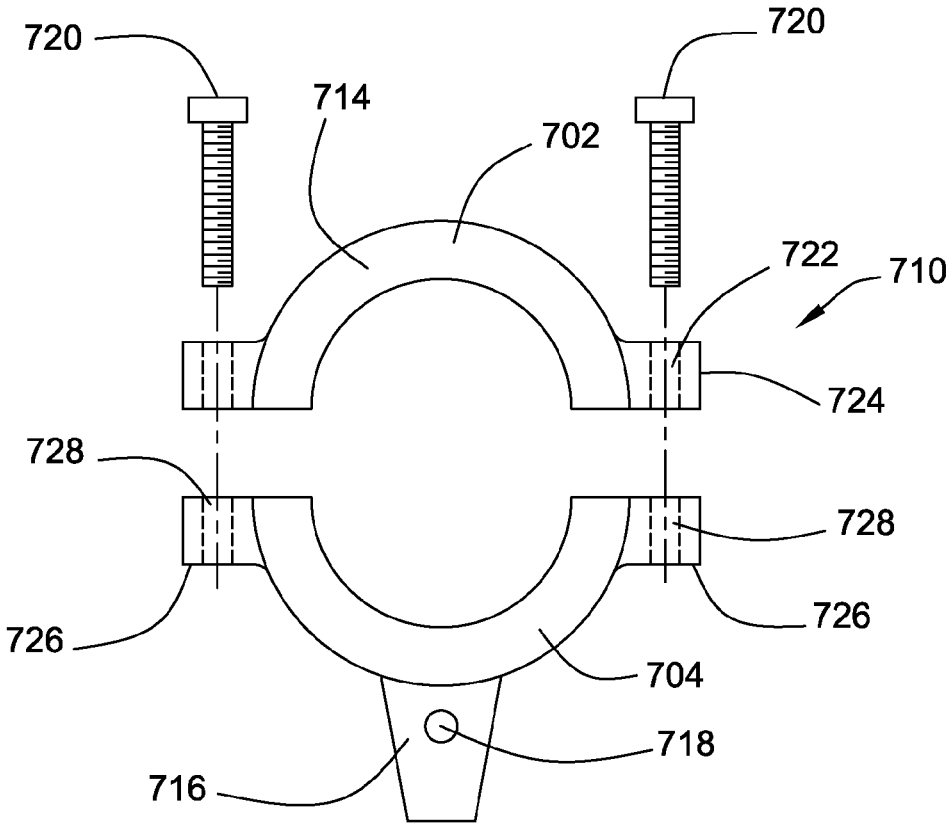
FIG. 7 is an expanded view of a hold down clamp assembly.
Figure 8:
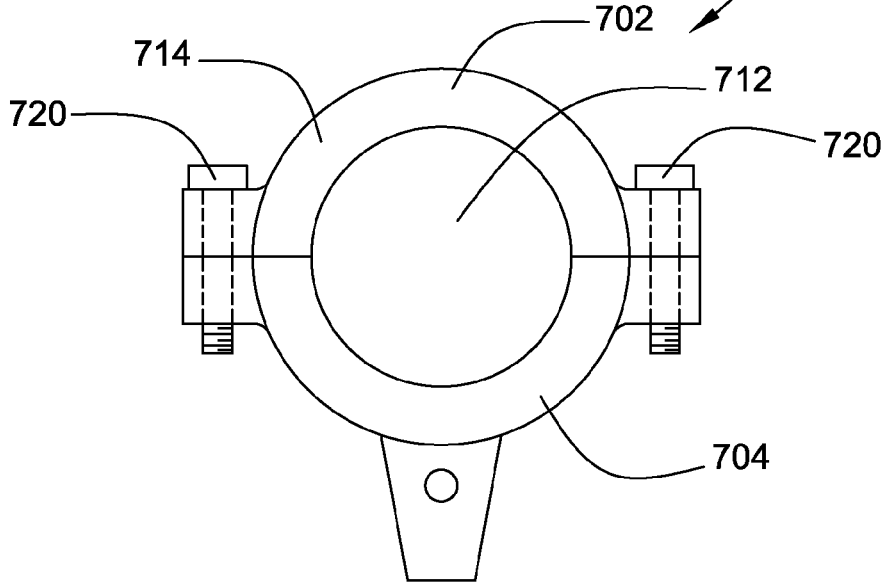
FIG. 8 is an assembled view of the hold down clamp assembly, in accordance with the disclosure.

The embodiment presented in FIGS. 7 and 8 is one example of a possible clamp configuration that allows for assembly around the injector 200. In this embodiment, a clamp 710 includes a first generally C-shaped portion 702 and a second generally C-shaped portion 704. The first generally C-shaped portion 702 and the second generally C-shaped portion 704 form the clamp 710 when assembled together. Each of the first generally C-shaped portion 702 and the second generally C-shaped portion 704 includes a segment which, when assembled, together form the entire circular opening 712 of the clamp 710. Even though the first generally C-shaped portion 702 and the second generally C-shaped portion 704 are shown in this embodiment to have semicircular shapes, it can be appreciated that any other segmentation or shape of portions of the clamp may be used.

More particularly, the first portion 702 forms the first half of the injector engaging portion 714 of the clamp 710. The second portion 704 forms the remaining segment of the injector engaging portion 714 of the clamp 710 and also includes the fastener portion 716, which forms the fastener opening 718. During assembly, each of the first and second portions 702 and 704 are placed around the neck region 212 of the injector 200. Subsequently, the first portion 702 is connected to the second portion 704 with two connecting fasteners 720. Each of the connecting fasteners 720 passes through an opening 722 formed in a respective boss 724. Two bosses 724 are formed in the first portion 702 and are disposed in diametrically opposite positions across the segment of the opening 712 formed in the first portion 702. Each boss 724 mates with a corresponding boss 726 formed in the second portion 704. Each corresponding boss 726 forms a threaded opening 728, which threadably engages each fastener 720 when the clamp 710 is assembled around the injector 200. After the clamp 710 has been assembled, a fastener (not shown) passes through the fastener opening 718 to connect the clamp 710 to the engine and thus secure the injector 200.

INDUSTRIAL APPLICABILITY

The present disclosure is applicable to internal combustion engines using fuel injectors to inject fuel at a high pressure into cylinders of the engine during operation. The apparatus and methods disclosed herein are advantageously effective in cooling the fuel injectors so that electronic components associated therewith operate at lower temperatures, and further, the buildup of debris onto various internal components of the fuel injectors due to oxidization of fuel is avoided.

An internal combustion engine, in accordance with one embodiment, may include one or more fuel injectors, each fuel injector associated with a respective cylinder of the engine. Each cylinder of the engine may operate in association with at least one intake valve, at least one exhaust valve, and an arrangement to operate these valves, for example, valve lifters, overhead cam actuators, and so forth. The engine may further include a lubrication and cooling system using oil as its operating fluid. This oil may be supplied to the actuation mechanism for the intake and exhaust valves of the engine, and may even be supplied separately via an oil distribution system used for lubricating various moving parts of the engine as well as cooling the one or more fuel injectors. Accordingly, a method for cooling at least one fuel injector associated with an internal combustion engine includes mounting the fuel injector to the engine using an injector clamp such that an annular volume is formed along at least a portion of a body of the fuel injector and the clamp. The clamp may include an opening surrounded by a lip that can be used to collect lubrication oil into the annular volume.

Figure 9:
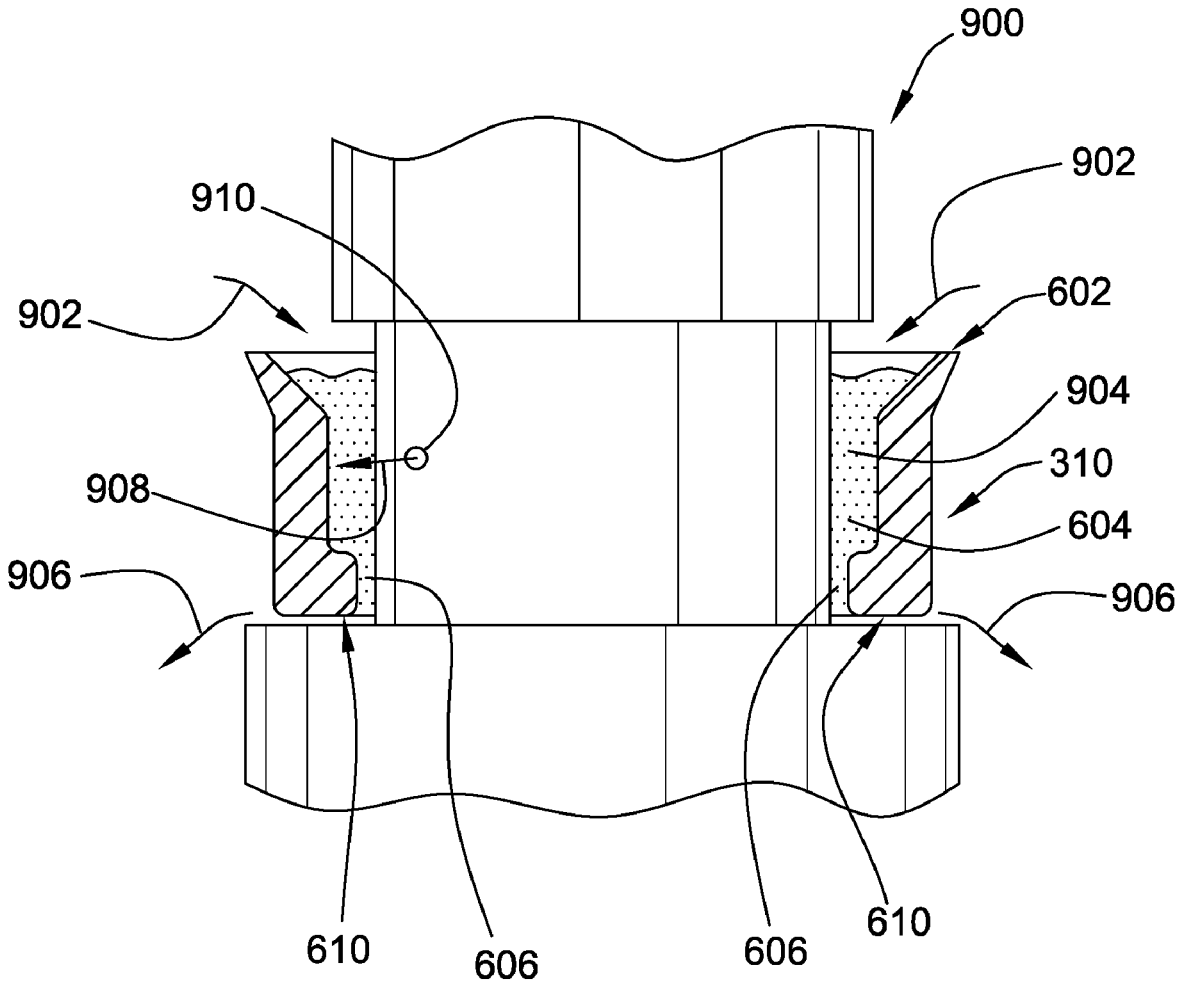
FIG. 9 is a partial cross section of a fuel injector having a hold down clamp assembled around its neck region during operation of an internal combustion engine in accordance with the disclosure.

A partial cross section of an injector 900 is shown in FIG. 9. The injector 900 is shown assembled in an internal combustion engine and retained by an injector clamp 310. In this figure, the injector is shown in a condition while the engine is operating. Here, the annular volume 604 is shown having collected a quantity of lubrication fluid 904 that has entered through the opening 602 between the injector 900 and the clamp 310. As described above, the funnel-shape of the opening 602 is arranged to collect fluid during operation. As such, a flow of lubrication fluid 902 enters the annular volume 604 and collects therein.

The quantity of fluid 904 collected in the annular volume 604 is advantageously used to absorb heat from the injector 900 during operation. The quantity of fluid 904 can then relatively slowly drain out of the leak paths 606 and 610 carrying with it the heat it absorbed from the injector 900. Hence, a flow of fluid 906 exiting the annular volume 604 can effectively cool the injector 900 by removing heat from the exterior surface of the injector 900 during operation. The flow of fluid 906 exiting the leak paths 606 and 610 tends to reduce the quantity of fluid 904 in the annular volume 604, which is continuously replenished by additional oil entering through the opening 602 such that the quantity of fluid 904 remains substantially constant.

In the embodiment shown, the injector 900 may use lubrication fluid for intensification of the pressure of fuel being injected during operation. The fluid used for intensification tends to be at an elevated temperature when exiting the fuel injector 900. For this reason, the lubrication fluid used for intensification is arranged to exit the injector 900 via an opening 910 formed in the injector 900, which opening 910 is in fluid communication with the annular volume 604. This flow of lubrication fluid, denoted generally as 908, would typically linger on the surface of the injector 900 imparting heat thereto. In this embodiment, the flow of fluid 908 exiting the injector 900 is mixed with the quantity of fluid 904 in the annular volume 604 and is then removed from the annular volume 604 via the leak paths 610 and 606.

Figure 10:
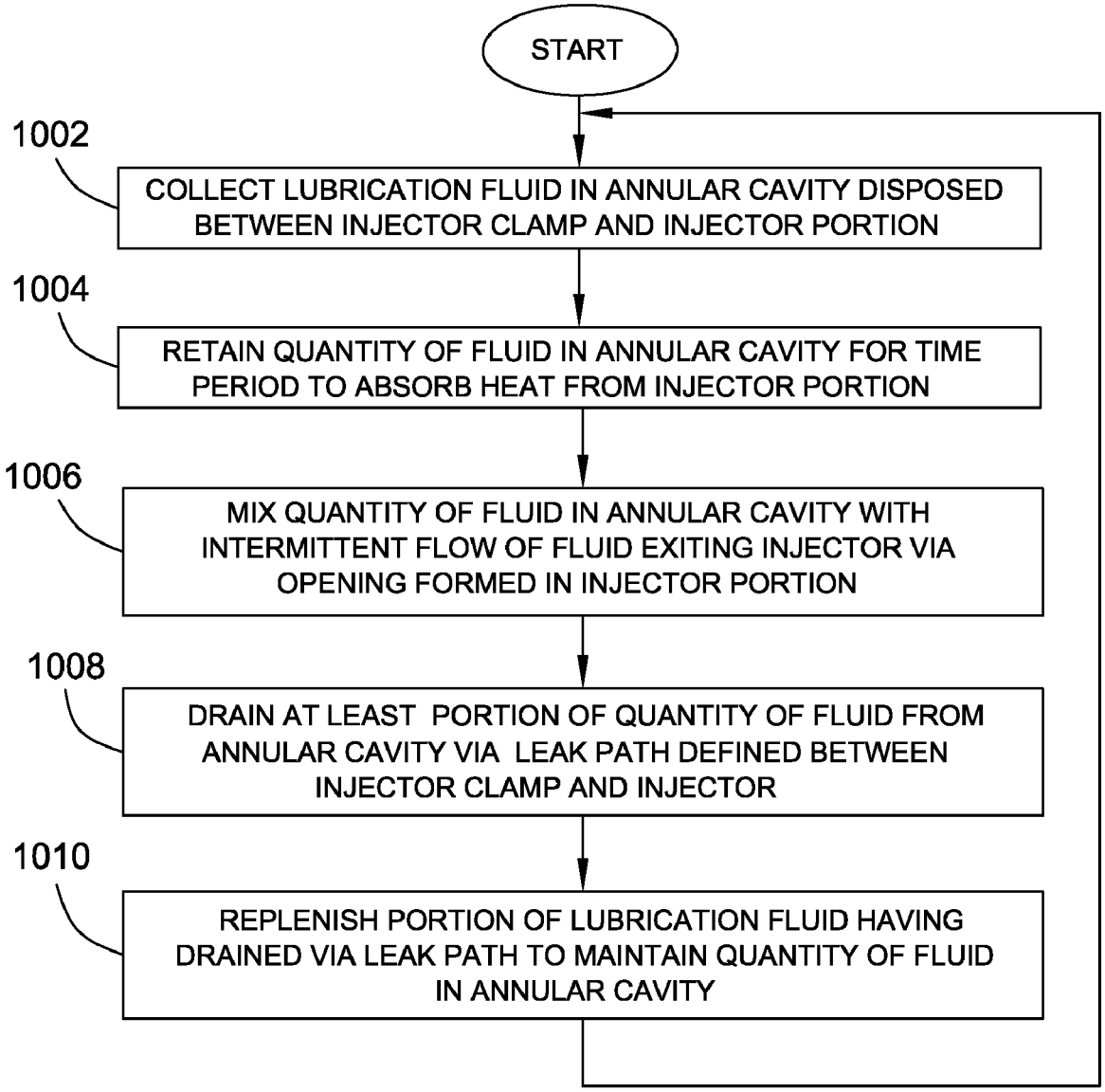
FIG. 10 is a flowchart for a method of cooling a fuel injector in accordance with the disclosure.

In accordance with the foregoing, a flowchart for a method of removing heat from an injector is shown in FIG. 10. During operation of an internal combustion engine, lubrication fluid is collected in an annular volume disposed between an injector clamp and a portion of the injector at 1002. The lubrication fluid collected is retained in the annular volume for a period of time allowing it to absorb heat from the injector portion either convectively and/or conductively at 1004. Optionally, in certain embodiments, this quantity of fluid in the annular volume can be mixed with a continuous and/or intermittent flow of fluid exiting the injector via an opening formed in the injector portion at 1006. At least a portion of the quantity of fluid from the annular volume is drained via a leak path defined between the injector clamp and the injector at 1008. The portion of lubrication fluid having drained via the leak path is replenished to maintain the quantity of fluid in the annular volume at 1010, and the entire cooling process is repeated while the engine operates.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. An internal combustion engine, comprising:

a crankcase forming a plurality of cylinders;

a plurality of fuel injectors, each fuel injector operably associated with a respective one of the plurality of cylinders;

a cylinder head connected to the crankcase, the cylinder head forming a plurality of injector bores, each of the plurality of fuel injectors disposed in a respective one of the plurality of injector bores;

a plurality of injector clamps, each of which is arranged to secure a respective one of the plurality of fuel injectors to the crankcase while such fuel injector is located within a respective one of the plurality of injector bores;

wherein each fuel injector forms a neck region, and wherein each clamp surrounds each fuel injector around the neck region;

a plurality of annular volumes defined, one each, between the neck region of each fuel injector and each injector clamp, each annular volume disposed to collect a quantity of lubrication oil during operation of the internal combustion engine such that oil collected in each respective annular volume removes heat from each fuel injector.

2. The internal combustion engine of claim 1, wherein a leak path is defined between a portion of the neck region of each injector and each injector clamp such that at least a portion of the quantity of lubrication oil collected in each annular volume can leak out of each annular volume during operation of the internal combustion engine.

3. The internal combustion engine of claim 1, wherein a respective opening is defined between each fuel injector and each injector clamp, each respective opening fluidly communicating with each annular volume such that lubrication oil enters each annular volume and collects therein during operation of the internal combustion engine.

4. The internal combustion engine of claim 3, further including a lip formed on each injector clamp, each lip surrounding each respective opening;

wherein each lip defines an edge of a funnel shaped portion of each injector clamp that is arranged to collect lubrication fluid into each annular volume during operation of the internal combustion engine.

5. The internal combustion engine of claim 1, wherein each injector clamp includes an injector retaining portion and a fastener portion;

the injector retaining portion forming an injector opening arranged to accept the neck region formed on each fuel injector;

the fastener portion forming a fastener opening adapted to receive a fastener passing therethrough, the fastener operably engaging a portion of the internal combustion engine such that each fuel injector disposed within the injector retaining portion is secured to the internal combustion engine.

6. The internal combustion engine of claim 1, wherein each injector clamp includes:

a first portion including a first segment of an injector opening and two bosses disposed at diametrically opposite locations along the first segment, each boss forming an opening; and a second portion forming a remaining segment of the injector opening, the second portion including a fastener portion forming a fastener opening, the second portion further including two fastener bosses, each fastener boss forming a threaded opening;

wherein each fastener boss is arranged to mate with each of the two bosses formed on the first portion.

7. A method for cooling a fuel injector in an internal combustion engine, comprising:

collecting fluid in an annular volume disposed between a fuel injector clamp and a portion of the fuel injector;

retaining a quantity of fluid in the annular volume for a time period;

absorbing heat from a portion of the fuel injector that at least partially defines the annular volume with the quantity of fluid collected in the annular volume;

draining at least a portion of the quantity of fluid from the annular volume via a leak path defined between the fuel injector clamp and the fuel injector;

replenishing the portion of the quantity of fluid having drained via the leak path to maintain the quantity of fluid in each annular volume substantially constant.

8. The method of claim 7, further including mixing the quantity of fluid in the annular volume with a flow of fluid exiting the fuel injector via an opening formed in the portion of the fuel injector that it is in fluid communication with the annular volume.

9. The method of claim 8, wherein replenishing the portion of the quantity of fluid further includes filling at least a portion of the annular volume with the flow of fluid exiting the fuel injector via the opening formed in the fuel injector.

10. The method of claim 7, wherein replenishing the portion of the quantity of fluid includes allowing fluid to enter into the annular volume via an opening defined between the fuel injector clamp and the fuel injector.

11. The method of claim 10, further including funneling a flow of fluid passing through the opening into the annular volume by a funnel-shaped feature formed in the fuel injector clamp.

12. The method of claim 10, further including directing a flow of fluid toward the opening with a nozzle.

13. An injector hold-down clamp for securing a fuel injector to an internal combustion engine, the injector hold-down clamp comprising:

an injector retaining portion forming an injector opening adapted to accept a neck region formed on each fuel injector;

a lip formed on the injector retaining portion and surrounding the injector opening;

a fastener portion forming a fastener opening adapted to receive a fastener passing therethrough, the fastener operably engaging a portion of the internal combustion engine such that the fuel injector disposed within the injector retaining portion is secured to the internal combustion engine;

wherein the injector hold-down clamp is separable into at least two portions, a first portion of the injector hold-down clamp including a first segment of the injector opening, and a second portion of the injector hold-down clamp forming a remaining segment of the injector opening.

14. The injector hold-down clamp of claim 13, wherein the lip defines an edge of a funnel shaped portion of the injector hold-down clamp that is arranged to collect fluid into an annular volume defined at least partially within the injector retaining portion.

15. The injector hold-down clamp of claim 13, wherein the first segment and the remaining segment have a generally semi-circular shape.

16. The injector hold-down clamp of claim 13, wherein the first portion of the injector hold-down clamp forms two bosses disposed at diametrically opposite locations along the first segment, each boss forming an opening.

17. The injector hold-down clamp of claim 16, wherein the second portion of the injector hold-down clamp forms two fastener bosses, each of the two fastener bosses forming a threaded opening and arranged to mate with a respective one of the two bosses formed on the first portion.

18. The injector hold-down clamp of claim 13, wherein the fastener portion is adapted to connect the injector hold-down clamp to a component of an internal combustion engine.

19. The injector hold-down clamp of claim 13, further including a neck portion disposed between the injector retaining portion and the fastener portion.

20. The injector hold-down clamp of claim 13, further including a funnel-shaped portion formed along one edge of the injector retaining portion.

* * * * *